United States Patent [19]

Henrie

[11] 4,004,810

[45] Jan. 25, 1977

[54] GAME APPARATUS

[76] Inventor: Darwin E. Henrie, 1194 N. 3000 West, Clinton, Utah 84015

[22] Filed: Nov. 17, 1975

[21] Appl. No.: 632,189

[52] U.S. Cl. ..... 273/134 GM; 273/134 C; 273/134 D

[51] Int. Cl.[2] ..... A63F 3/00

[58] Field of Search ..... 273/131, 134

[56] References Cited

UNITED STATES PATENTS

| | | | |
|---|---|---|---|
| 1,240,756 | 9/1917 | Moore | 273/134 AB |

FOREIGN PATENTS OR APPLICATIONS

| | | | |
|---|---|---|---|
| 42,331 | 5/1910 | Austria | 273/134 GA |
| 1,298,367 | 6/1962 | France | 273/134 AE |
| 808,548 | 7/1951 | Germany | 273/131 B |

*Primary Examiner*—Delbert B. Lowe
*Attorney, Agent, or Firm*—Criddle, Thorpe & Western

[57] ABSTRACT

A game including a board with a polygonal playing area divided into a plurality of wedge-shaped segments, each for use by a different player. A pathway is included in each segment, each pathway being divided into a plurality of playing spaces over which a playing piece is moved. Each pathway has a finishing position which is common with the other pathways, and also a starting position. At various points along each pathway, the pathway branches into first and second paths which thereafter rejoin. The first path of each branching portion of a pathway contains a greater number of playing spaces than does the second path of the branching portion. Also included are a plurality of gate elements, each disposed adjacent a different one of the second paths for movement between a first position in which the gate element "blocks" the passage of a playing piece, and a second position in which the gate element does not block the passage of a playing piece. A plurality of cards are provided with the cards having various instructions inscribed thereon regarding movement of playing pieces or movement of the gate elements between the two positions. A die is provided the players and is used to determine the actions taken by the players.

15 Claims, 8 Drawing Figures

GAME APPARATUS

BACKGROUND OF THE INVENTION

This invention relates to game apparatus in which playing pieces are moved over pathways on a game board.

A variety of games have been devised which provide for movement of playing pieces over pathways which are divided into playing spaces. See, for example, W. H. Nicholas, U.S. Pat. No. 1,357,109 and R. Seed, U.S. Pat. No. 1,095,934. Games have also been suggested which provide labyrinths or mazes through which a playing piece or element is moved from a starting position to a finishing position. See E. S. Boynton, U.S. Pat. No. 2,011,266, M. J. Handweiler, U.S. Pat. No. 3,625,516 and D. W. Palmer, U.S. Pat. No. 3,820,793.

It is an object of the present invention to provide a new and different game apparatus having pathways over which playing pieces are moved and a plurality of gate elements located along the pathways for either inhibiting or allowing movement of the playing pieces along the pathways.

SUMMARY OF THE INVENTION

The above and other objects of the present invention are realized in an illustrative embodiment which includes a game board having a playing area divided into at least two segments, each for use by a different player and each including a pathway inscribed thereon having a starting position and a finishing position. Each pathway is divided into a plurality of playing spaces over which a playing piece is moved and each has a plurality of loops which branch from the pathway at various locations therealong and thereafter rejoin the pathway or another loop at locations closer to the finishing position. The loops thus provide alternate paths around corresponding primary portions of the pathway. A plurality of gate elements are disposed on the game board playing area at various positions along each pathway, each gate element being adapted for manual adjustment to either a blocking condition for preventing movement of a playing piece therepast or a nonblocking position for allowing movement of a playing piece. A device, such as a die, is provided for randomly presenting any one of a plurality of numerical values which are preassigned to indicate actions which the players may take.

In accordance with one aspect of the invention, a plurality of cards are provided with the cards having various instructions inscribed thereon regarding movement of playing pieces or adjustment of gate elements.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
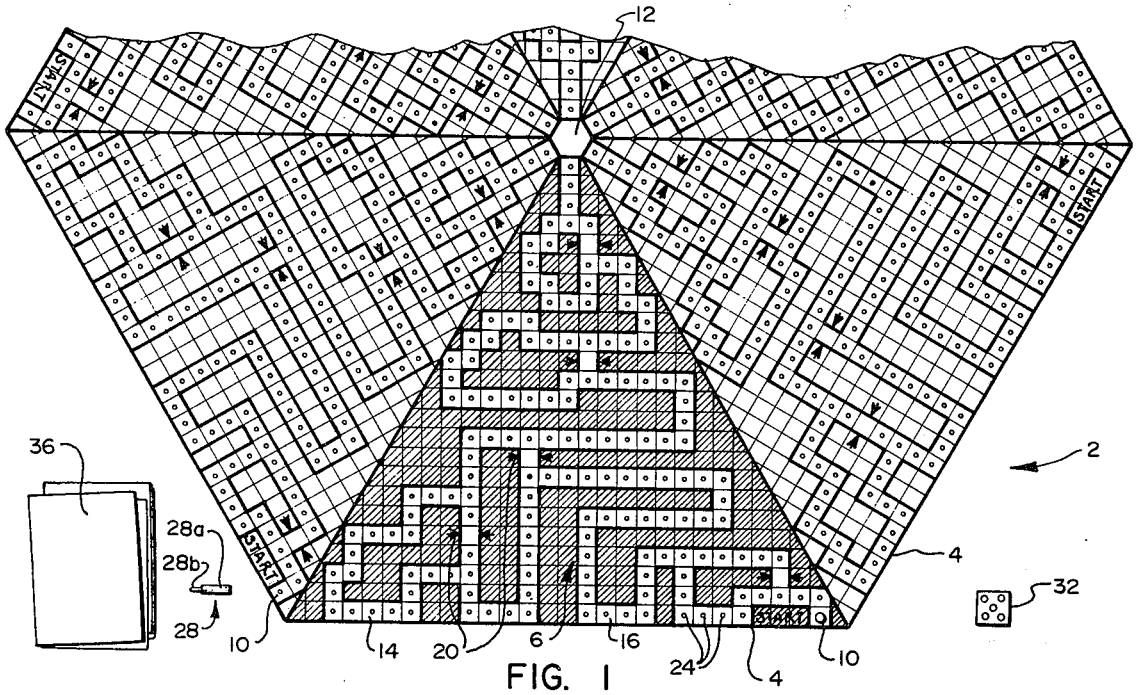
FIG. 1 is a fragmented plan view of game board apparatus made in accordance with the present invention showing a playing area divided into six segments.

Referring to FIG. 1, there is shown one illustrative embodiment of a game board of the present invention. The game board includes a generally planar surface hexagonal playing area 2 divided into six wedge-shaped segments 4 each for use by a different player. The apex of each segment is contiguous with the apices of the other segments and each side of a segment is contiguous with the side of another adjacent segment. Although the segments 4 are wedge-shaped in the embodiment of FIG. 1, it will become apparent that a variety of shapes could be employed for the playing area.

Each segment 4 has a pathway 6 inscribed thereon, each pathway being divided into a plurality of rectangular playing spaces over which playing pieces are to be moved. Each pathway has a starting space or position 10, located at the base of the corresponding segment, and a finishing position 12 located in the center of the playing area and common to all of the pathways. Advantageously, each segment has a different pathway background color to better distinguish and set apart each segment from the other segments.

The pathways of each segment are identical in shape and each contains the same number of playing spaces as the other pathways. Each pathway includes a plurality of loops, such as loops 14 and 16, which branch from what might be referred to as primary portions of the pathway or from other loops. These loops then rejoin either the primary portion of the pathway or other loops at locations closer to the finishing position 12. Having such loops presents the players with a variety of paths for reaching the finishing position 12 from the starting position 10. Of course, as is apparent from an examination of the pathways, if a playing piece is moved over the loops rather than over the corresponding primary portions of the pathway, then a greater number of playing spaces must be traversed. For the pathways 6 of the embodiment of FIG. 1, the number of playing spaces from the starting position 10 taking the longest route or path to the finishing position 12 is 146 whereas the number of playing spaces taking the shortest route is 55.

Also provided on the game board are a plurality of gate elements each represented schematically by double arrows 20. These gate elements are positioned at various locations alongside the pathways and, as will be further explained later, function to either block the movement of a playing piece along a certain portion of the pathway or to allow such movement. The gate elements 20 are located along the primary portions of the pathway rather than along the loops so that if a playing piece is to be moved over a shorter route from the starting position 10 to the finishing position 12, it must traverse or pass through the gate elements.

Each playing space of the pathways is provided with a hole 24 into which may be inserted one end of a playing piece such as playing piece 28. The playing piece 28 includes a cylindrical grasping portion 28*a* and a narrower insertion portion 28*b* extending from the grasping portion and adapted for insertion into the holes 24. When a playing piece is moved over a pathway, the portion **28*b* of the piece is simply inserted into the hole of the playing space on which the playing piece comes to rest. Of course, a variety of playing piece designs could be provided, some of which need not utilize the holes 24** in the playing spaces.

Movement of the playing pieces is determined by the players rolling a die, such as die 32, and also by following instructions written on a plurality of cards 36. The numerical value shown on the die 32 after shaking and rolling it, and the instructions on the cards determine such things as the number of spaces which a playing piece may be moved, whether the playing piece is to be moved forward or backward, and the adjustment of the gate elements 20 to either block or allow passage of the playing pieces.

Figure 2A:
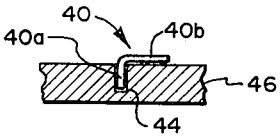
FIG. 2A is a side elevational view of one illustrative embodiment of a gate element.
Figure 2B:
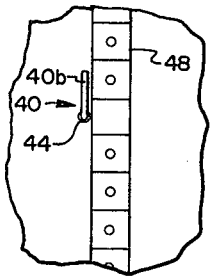
FIGS. 2B and 2C are top plan views of the gate element of FIG. 2A showing respectively an open position and a closed position.
Figure 2C:
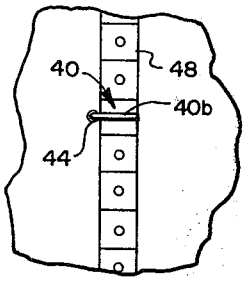
Figure 3A:
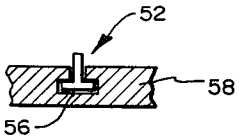
FIGS. 3A and 3B are end and side elevational views respectively of another embodiment of a gate element.
Figure 3B:
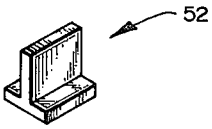
Figure 3C:
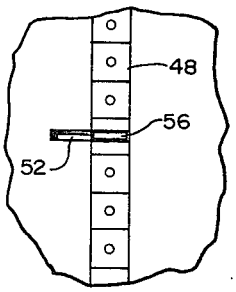
FIGS. 3C and 3D are top plan views of the gate element of FIGS. 3A and 3B showing respectively the gate element in the open position and the closed position.
Figure 3D:
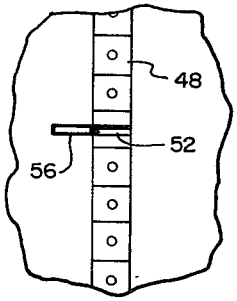

One embodiment of a gate element is shown in composite FIG. 2 with FIG. 2A showing an elevational view of such element and FIGS. 2B and 2C showing top plan views thereof. As best seen in FIG. 2A, the gate element 40 is L-shaped, with one leg **40*a* of the element being inserted into a hole 44 of the game board 46, and the other leg 40*b* lying on the upper surface of the game board. The gate element 40 may be swiveled in the hole 44 so that the leg 40*b* either blocks a portion of a path 48 alongside which the gate element 40 is located (FIG. 2C) or does not block the path (FIG. 2B). The condition or position of the gate element 40** when it blocks a path is referred to as the "close" position and the condition or position of the gate element when it does not block the path is referred to as the "open" position.

Composite FIG. 3 shows another embodiment of a gate element which consists of a slidable tab member 52 which is received in and carried by a slot 56 in the game board 58. FIG. 3A is an end view of the tab member 52 which is shaped in the form of an inverted T. FIG. 3B shows a side elevational view of the member 52. The slot 56 in the game board is shaped to receive the member 52 and permit it to slide longitudinally therein. The slot 56 extends across a corresponding portion of a path 48, as shown in FIGS. 3C and 3D, and laterally of the path a certain distance. The member 52 is slidable from a position to the side of the path, referred to as the open position (FIG. 3C), to a position in which the tab member 52 is in the path 48, referred to as the close position (FIG. 3D). Of course, a variety of gate element designs are possible for indicating either an open or close position to respectively allow or block movement of a playing piece.

As earlier indicated, each segment 4 is for use by a different player so that with the game board of FIG. 1, up to six players can play the game. Each player has a playing piece 28 for movement along the pathway of his segment. The game is played with the single die 32, with each player throwing the die in turn. The game begins with all gate elements 20 in the close position and the playing pieces 28 in their respective starting positions 10. The object of the game is for a player to be the first to arrive at the finishing position 12.

One player is chosen randomly to begin the game and then each player plays in turn thereafter. The following are exemplary rules of action which a player is to take depending upon the numerical value showing on the die 32 after that player rolls that die:

Die showing 1 — player moves playing piece one space along his pathway and shakes again.

Die showing 2 — player may open or close any gate (either his own or someone elses) or he may move two holes. Either of the two, but not both, actions may be taken.

Die showing 3, 4 or 5 — player moves his playing piece a number of spaces corresponding to the value showing on the die.

Die showing 6 — player draws a card and follows the instruction on the card.

As indicated earlier, the first player to reach the finishing position 12 wins the game. To reach the finishing position, a player must have showing on the die the exact number necessary for him to reach the finishing position from his current playing space. If the die shows a number greater than the number of spaces the player has to move, then the player must move backward toward the starting position 10 the number of spaces shown on the die.

The following are exemplary instructions which may be inscribed on the cards:

1. "Open any gate element".
2. "Move forward X number of playing spaces" (X may be any of a variety of values.)
3. "Move back behind the last gate element and close the gate element if it is open".
4. "Close any gate element".
5. "Close your next forward gate element".
6. "Move back X number of playing spaces" (where X may be any of a variety of values).
7. "Close all gate elements".
8. "Shake the die again".
9. "Miss next turn".
10. "Open forward gate elements of any opponent".
11. "Close all gate elements except your own".

The indicated instructions are only exemplary of the kinds of instructions which can be placed on the cards.

In the manner described, a simple and yet stimulating game is provided for use by two or more players. The game is simple to learn and may be played by persons of nearly any age group.

It is to be understood that the above-described arrangements are only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A game for at least two players comprising a game board having a generally planar surface playing area divided into at least two segments, each for use by a different player, each segment including a pathway inscribed thereon having a starting position and a finishing position, each pathway being divided into a plurality of playing spaces over which a playing piece is moved and each having a plurality of loops which branch from the pathway at various locations therealong and rejoin the pathway or another loop at locations closer to the finishing position, each of said loops providing an alternate path around a corresponding primary portion of the pathway over which a playing piece may be moved.

a plurality of gate elements disposed on the game board playing area in each segment at a plurality of positions along each pathway, each gate element being adapted for movement between a close position, for blocking movement of a playing piece along the corresponding pathway past the element, and an open position, for allowing movement of a playing piece along the pathway past the element, and a device usable by the players for randomly presenting any one of a plurality of numerical values which are preassigned to indicate actions which the players may take.

2. A game as in claim 1 further comprising a plurality of cards having various instructions thereon regarding movement of playing pieces or movement of the gate elements between the close and open positions.

3. A game as in claim 2 wherein the gate elements are positioned along said primary portions of the pathways.

4. A game as in claim 3 wherein the number of playing spaces in each of said loops is greater than the number of playing spaces in the corresponding primary portion of a pathway.

5. A game as in claim 4 wherein each of said segments is wedge-shaped, and said segments are arranged so that the apexes of the segments are generally contiguous, and each side of a segment is contiguous with a side of another segment.

6. A game as in claim 5 wherein the starting position of each pathway is near the base of the segment in which the pathway is located, and the finishing position is near the apex of the segment.

7. A game as in claim 1 wherein each playing space of a pathway has a hole therein, said game further comprising at least two playing pieces, each being adapted so that a portion thereof may be inserted into said holes.

8. A game as in claim 1 wherein the game board has a plurality of holes therein each located at a different one of said positions along the pathways, and wherein each of said gate elements include an L-shaped member, one leg of which is inserted into one of the holes in the game board so that the other leg may be rotated over the surface of the board to either the close position over the corresponding pathway or the open position off the pathway.

9. A game as in claim 1 wherein the game board has a plurality of elongated slots therein, each located at a different one of said positions along the pathways and extending generally perpendicularly through a corresponding pathway and laterally a certain distance from one side of the pathway, and wherein each of said gate elements includes an elongated tab member formed to fit within the slots so that a portion of the tab extends above the surface of the game board, said tabs being slidable longitudinally in the slots between the close position when the tab member is in that portion of the slot which extends through a pathway, and the open position when the tab member is in the portion of the slot which extends laterally from one side of the pathway.

10. A game for at least two players comprising a game board having a playing area divided into at least two sections, each for use by a different player, each section including a pathway upon the face thereof divided into a plurality of spaces, each pathway successively branching, at various points therealong, into first and second paths which thereafter rejoin, the first path of each such branch having a greater number of spaces than the second path thereof, a plurality of gate elements disposed on the game board playing area in each section at a plurality of positions along each pathway, each gate element being positioned generally adjacent a different one of said second paths for manual adjustment to either a first position or a second position, and a device usable by the players for randomly presenting any one of a plurality of numerical values which are preassigned to indicate actions which the players may take.

11. A game as in claim 10 further comprising a plurality of cards having various instructions thereon regarding movement of playing pieces or adjustment of the gate elements.

12. A game as in claim 11 wherein the sections are arranged on the game board to have a common center.

13. A game as in claim 12 wherein each of said sections is wedge-shaped, said sections being arranged so that the apexes of the sections are generally contiguous to define the common center and each side of a section is contiguous with the side of another section.

14. A game as in claim 13 wherein each pathway includes a starting position located near the base of the corresponding section, and a finishing position located at the common center.

15. A game as in claim 10 wherein each of said gate elements is adapted for movement between a position in which the element extends across a corresponding pathway and a position in which the element does not extend across the pathway.

* * * * *